US008087123B2

(12) United States Patent
Merz

(10) Patent No.: US 8,087,123 B2
(45) Date of Patent: Jan. 3, 2012

(54) FLOOR CLEANING APPLIANCE

(75) Inventor: Juergen Merz, Waiblingen (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/803,954

(22) Filed: Jul. 8, 2010

(65) Prior Publication Data

US 2011/0005027 A1 Jan. 13, 2011

Related U.S. Application Data

(63) Continuation of application No. PCT/EP2009/000415, filed on Jan. 23, 2009.

(30) Foreign Application Priority Data

Feb. 1, 2008 (DE) ..... 10 2008 008 066

(51) Int. Cl.
*A47L 7/00* (2006.01)
*A47L 9/00* (2006.01)

(52) U.S. Cl. ..... 15/320; 15/327.2; 15/347; 15/383

(58) Field of Classification Search ..... 15/320, 15/327.2, 347, 383; *A47L 7/00, 9/00, 9/10*
See application file for complete search history.

(56) References Cited

U.S. PATENT DOCUMENTS

| | | | |
|---|---|---|---|
| 5,301,386 | A | 4/1994 | Thomas et al. |
| 5,383,251 | A | 1/1995 | Whitaker et al. |
| 6,088,873 | A | 7/2000 | Pacchini et al. |
| 2003/0051306 | A1 | 3/2003 | Morgan et al. |

FOREIGN PATENT DOCUMENTS

| | | |
|---|---|---|
| DE | 30 05 238 | 8/1981 |
| DE | 10 2004 053 509 | 5/2006 |
| DE | 10 2008 008 069 | 8/2009 |

*Primary Examiner* — David Redding
(74) *Attorney, Agent, or Firm* — Lipsitz & McAllister, LLC

(57) ABSTRACT

The invention relates to a floor cleaning appliance comprising a housing, on the underside of which is arranged at least one drivable cleaning tool for removing dirt from a surface to be cleaned, and further comprising a suction unit for vacuuming-off the dirt and a dirt container for receiving the vacuumed-off dirt. In order to so develop such a floor cleaning appliance that it is easier to service, it is proposed in accordance with the invention that the housing comprise a dirt container receptacle in which the dirt container is releasably positionable, and, in addition, at least one functional device receptacle for at least one functional device, the at least one functional device or a cover of the at least one functional device being freely accessible after removal of the dirt container from the dirt container receptacle.

26 Claims, 5 Drawing Sheets

FLOOR CLEANING APPLIANCE

This application is a continuation of international application number PCT/EP2009/000415 filed on Jan. 23, 2009 and claims the benefit of German Patent Application No. 10 2008 008 066.7 filed on Feb. 1, 2008.

The present disclosure relates to the subject matter disclosed in international application number PCT/EP2009/000415 of Jan. 23, 2009 and German application number 10 2008 008 066.7 of Feb. 1, 2008, which are incorporated herein by reference in their entirety and for all purposes.

BACKGROUND OF THE INVENTION

The invention relates to a floor cleaning appliance comprising a housing, on the underside of which is arranged at least one drivable cleaning tool for removing dirt from a surface to be cleaned, and further comprising a suction unit for vacuuming-off the dirt and a dirt container for receiving the vacuumed-off dirt.

The object of the present invention is to so develop such a floor cleaning appliance that it is easier to service.

SUMMARY OF THE INVENTION

This object is accomplished, in accordance with invention, with a floor cleaning appliance of the kind mentioned at the outset in that the housing comprises a dirt container receptacle in which the dirt container is releasably positionable, and, in addition, at least one functional device receptacle for at least one functional device, the at least one functional device or a cover of the at least one functional device being freely accessible after removal of the dirt container from the dirt container receptacle.

Owing to the dirt container being detachably removable from the dirt container receptacle, it is possible to transport the dirt container, for example, for emptying purposes, to a place remote from the floor cleaning appliance, so that there is no necessity to transport the entire floor cleaning appliance. The dirt container is preferably adapted to be arranged without the need for tools in the dirt container receptacle and to be removed from the dirt container receptacle without the need for tools.

The floor cleaning appliance according to the invention also comprises at least one functional device receptacle for at least one functional device of the floor cleaning appliance. After detachment of the dirt container from the dirt container receptacle, the at least one functional device or a cover thereof, where provided, is freely accessible. This enables, for example, a user of the floor cleaning appliance to reach a functional device of the floor cleaning appliance in a convenient way, in order, for example, to carry out a visual check and, if required, exchange the functional device. To do so, he only has to remove the dirt, container from the dirt container receptacle. Therefore, even a technical layman can easily perform simple maintenance and/or repair work. Functional devices which ought not to be manipulated by the user but should be accessible to a service technician may be covered by a cover. The cover is accessible after removal of the dirt container from the dirt container receptacle. A service technician can remove the cover using a suitable tool and thereby gains access to functional devices which may, for example, have an electric voltage applied to them. These functional devices can then also be easily tested and, where required, exchanged. The floor cleaning appliance is therefore distinguished by a high level of service amenability.

It is expedient for the at least one functional device receptacle and/or the dirt container receptacle to be constructed in the form of a depression formed on the housing. The configuration as depression, which may, for example, be trough-shaped or groove-shaped, allows the at least one functional device receptacle and/or the dirt container receptacle to be formed in a constructionally simple manner. Also, the accessibility of the respective functional device is thereby further simplified.

Preferably, the at least one functional device receptacle and/or the dirt container receptacle is formed on the upper side of the housing. This makes it possible to arrange the dirt container and the at least one functional device at the upper side of the housing. The dirt container and/or the at least one functional device are then conveniently accessible to the user.

It is advantageous for a functional device receptacle to accommodate a liquid pump for conveying a cleaning liquid. The liquid pump constitutes a functional device. A cleaning liquid can be conveyed with it, for example, in order to act upon the surface to be cleaned with the cleaning liquid. Typically, the cleaning liquid is water to which a chemical cleaning agent may be added to increase the cleaning effect. The liquid pump is electrically connected to an electric power supply. It is, therefore, advantageous for it to be covered by a cover to protect it from being touched. The cover is accessible by removing the dirt container from the dirt container receptacle. Therefore, if required, the liquid pump can be easily exchanged by a service technician.

Preferably, at least one functional device receptacle accommodates at least one liquid pipeline. The liquid pipeline is a functional device by means of which the cleaning liquid can be conveyed. The liquid pipeline is expediently accommodated in a groove-shaped depression which forms a functional device receptacle. The liquid pipeline is readily accessible to a user of the floor cleaning appliance by removing the dirt container from the dirt container receptacle. Preferably, the liquid pipeline is transparent; for example, it may be in the form of a transparent hose. This enables a user to make a simple visual check, i.e., he can, for example, check whether the pipeline is clogged or leaking. If required, he can exchange the pipeline without having to call in a service technician to do this.

It is expedient for the liquid pump to be connectable to at least one liquid pipeline and/or for two or more liquid pipelines to be connectable to one another by plug-in connections. This increases the level of service amenability of the floor cleaning appliance as a user is able to easily separate a liquid pipeline from the liquid pump and/or two liquid pipelines from each other, for example, for maintenance and/or repair.

Advantageously, at least one functional device receptacle accommodates at least one electric device of the floor cleaning appliance, and the device is preferably covered by a cover to protect it from being touched. The electric device also constitutes a functional device. It may, for example, be a controlling and/or regulating device or an electric switching and/or connecting device or the like.

Preferably, at least one functional device receptacle accommodates at least one electric line. The electric line, which, for example, is connectable to a device of the aforementioned kind, is also a functional device of the floor cleaning appliance.

To further increase the level of service amenability of the floor cleaning appliance, it is expedient for the electric device to be connectable to at least one electric line and/or for two or more electric lines to be connectable to one another by plug-in connections. In this way, it is possible to easily separate the electric line from the electric device and/or two electric lines from each other.

Furthermore, it may be provided that the suction unit is connectable by plug-in connections to one or more electric lines.

Preferably, the suction unit is arranged at or on the upper side of the housing, and the floor cleaning appliance has a cover for covering the suction unit, the cover being releasably connectable to the housing and being freely accessible after removal of the dirt container from the dirt container receptacle. By arranging the suction unit at or on the upper side of the housing, the cover can be conveniently reached after removal of the dirt container from the dirt container receptacle, which, for example, facilitates maintenance and/or repair of the suction unit for a service technician. To expose the suction unit, the cover, which is releasably connectable to the housing, can be separated from the housing. It may be provided that the suction unit is held on the cover, so that when the cover is released from the housing, the suction unit is simultaneously released from the housing. It is, however, also possible for the suction unit to be acted upon with force by the cover and thereby fixed relative to it.

Preferably, the cover comprises a lower cover part by means of which the cover is releasably connectable to the housing, and an upper cover part which is releasably connectable to the lower cover part. The suction unit can be exposed by releasing the lower cover part from the housing or, if it is held on the cover, it can be separated together with the cover from the housing. A space in which the suction unit is arranged becomes accessible by the upper cover part being removed from the lower cover part. This may be of advantage, if, for example, for maintenance and/or repair of the suction unit, only an area thereof that can be reached by releasing the upper cover part from the lower cover part need be accessed.

Advantageously, the housing comprises at least one through-opening for passage of an electric line and/or a liquid pipeline therethrough as this makes it possible to impart a compact design to the floor cleaning appliance. For example, it may be provided that a cleaning liquid is conducted by a liquid pipeline passing through a through-opening to the underside of the housing in order to act upon the surface to be cleaned.

Preferably, the housing comprises at least one through-opening through which a medium that is drawn in or discharged by the suction unit is drawn in or discharged. The housing can thereby form, for example, a section of an intake duct arranged upstream of the suction unit or of a discharge duct arranged downstream of the suction unit. In the case of the intake duct, it may, for example, be provided that the through-opening forms an interface between a dirt pickup device for picking up the dislodged dirt from the surface to be cleaned and a suction pipe through which the dirt can pass into the interior of the dirt container. In the case of the discharge duct, it is, for example, possible to conduct the exhaust air of the suction unit in a specific way through the housing to a certain area.

The service amenability of the floor cleaning appliance can be further improved by the above-described through-openings of the housing and/or seals and/or filters adapted to be arranged thereon also being freely accessible after removal of the dirt container from the dirt container receptacle.

The floor cleaning appliance has a technically simple construction when the housing comprises an upper housing part and a lower housing part, the dirt container receptacle and/or the at least one functional device receptacle being arranged at the upper housing part, and the lower housing part forming at least one cleaning compartment in which at least one cleaning tool is arranged.

A compact design of the floor cleaning appliance can be achieved when a drive compartment is formed between the upper housing part and the lower housing part for accommodating a drive device by means of which the at least one cleaning tool is drivable.

In this case, it has proven advantageous for the floor cleaning appliance to comprise two cleaning tools constructed as roller-type brushes, which are mounted for rotation in two cleaning compartments on the housing, and for the drive device to be arranged in the drive compartment between the roller-type brushes and to have a drive axis extending parallel to the axes of rotation of the roller-type brushes. Dirt can be removed from the surface to be cleaned by the roller-type brushes. The arrangement of the drive device in the drive compartment between the roller-type brushes allows a compact design of the housing of the floor cleaning appliance. Owing to the coaxial alignment of the drive device and the roller-type brushes, a driving force can be transmitted in a technically simple way from the drive device onto the roller-type brushes.

The floor cleaning appliance is expediently constructed as a scrubber vacuum.

The floor cleaning appliance preferably comprises an exhaust air guiding device for directing an exhaust air flow of the exhaust air of the suction unit onto at least one cleaning tool. Owing to the exhaust air flow being directed onto the cleaning tool, the exhaust air is captured and spatially distributed by the cleaning tool as a result of its motion. It has been found that noise generation due to the typically high flow velocity of the exhaust air of the suction unit can thereby be effectively reduced. The high flow velocity of the exhaust air is a consequence of the need to equip the suction unit with high suction power in order to be able to effectively vacuum-off the dislodged dirt.

It is advantageous for the exhaust air flow to be directed by the exhaust air guiding device onto the side of the at least one cleaning tool that faces away from the surface to be cleaned. It has been found that the exhaust air flow can in this way be particularly effectively captured and spatially distributed by the cleaning tool, with the result that the noise generation can be further reduced. Furthermore, it is thereby possible to prevent dirt located on the surface to be cleaned from being spatially distributed in an undesired manner by the exhaust air flow.

The floor cleaning appliance preferably comprises an accommodating compartment for the suction unit and at least one cleaning compartment formed on the housing for accommodating at least one cleaning tool, the exhaust air guiding device forming at least one exhaust air duct by way of which the accommodating compartment is in flow connection with at least one cleaning compartment. The exhaust air flow can be reliably directed onto the cleaning tool by the exhaust air duct, so that an effective reduction in noise is achievable.

It may be provided that more than one cleaning tool is arranged in a cleaning compartment, with the exhaust air flow being directable onto only one or onto several cleaning tools, in particular, onto each cleaning tool. If the housing forms more than one cleaning compartment, it is then possible for several cleaning compartments, in particular, each of the cleaning compartments, to be in flow connection with the accommodating compartment.

Furthermore, it may be provided that a separate exhaust air duct formed, for example, by a hose is used in the floor cleaning appliance, with, for example, the hose ends extending into the accommodating compartment and the cleaning compartment in order to establish the flow connection.

A compact design can be imparted to the floor cleaning appliance when the housing delimits the exhaust air duct, at least in sections thereof.

The compact design described above can be achieved in a constructionally simple way when a section of the housing that delimits the exhaust air duct is formed as through-opening of the housing.

It is advantageous for the housing to comprise a wall delimiting the at least one cleaning compartment and forming at least one outlet opening of an exhaust air duct. This allows the exhaust air flow to be reliably directed onto a cleaning tool arranged in the cleaning compartment.

Preferably, the floor cleaning appliance comprises a cover which is releasably connectable to the housing and has a first section delimiting at least one exhaust air duct, at least in sections thereof. The exhaust air duct can be opened, at least in sections thereof, by releasing the cover from the housing. This enables objects which are blocking the exhaust air duct to be easily removed from the exhaust air duct. This embodiment therefore increases the service amenability of the floor cleaning appliance.

It is advantageous for the cover to have a second section, the accommodating compartment for the suction unit being formed between the second section and the housing. The cover can therefore cover the suction unit arranged in the accommodating compartment and delimit at least one exhaust air duct, at least in sections thereof.

The following description of a preferred embodiment of the invention serves in conjunction with the drawings for a more detailed explanation of the invention.

DETAILED DESCRIPTION OF THE INVENTION

Figure 1:
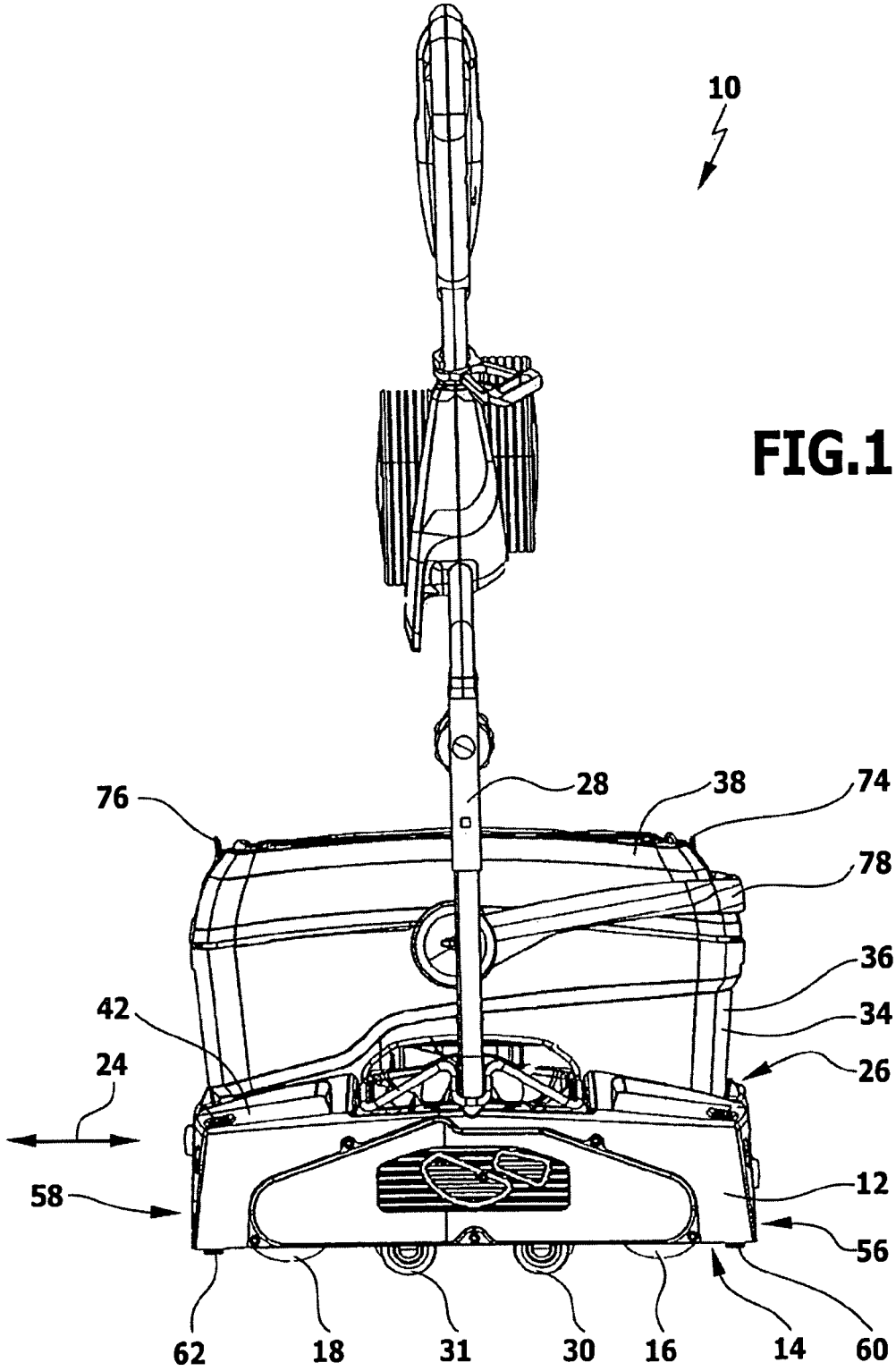
FIG. 1 shows a diagrammatic side view of a floor cleaning appliance according to the invention with a housing on which a dirty water tank and a fresh water tank are placed.

The drawings show diagrammatically a preferred embodiment of a floor cleaning appliance according to the invention which, in the present case, is constructed as a scrubber vacuum 10. It comprises a housing 12, on the underside 14 of which two cleaning tools in the form of two roller-type brushes 16 and 18 are mounted for rotation about two axes of rotation 20 and 22, respectively. The axes of rotation 20 and 22 extend parallel to a surface to be cleaned and are aligned perpendicularly to a cleaning direction of the scrubber vacuum 10, which is denoted by reference numeral 24 in FIG. 1.

A push bar 28 mounted on the upper side 26 of the housing 12 for pivotal movement about a pivot axis extending parallel to the axes of rotation 20 and 22 serves to move the scrubber vacuum 10 forwards or backwards along the cleaning direction 24. The push bar 28 is in operative connection, in a manner which is known and therefore not explained, with a pivot mechanism, not shown, by means of which supporting rollers 30, 31, 32 and 33 arranged on the underside 14 of the housing 12 may be raised and lowered in a vertical direction. When the push bar 28 is pivoted out of the vertical, the supporting rollers 30, 31, 32 and 33 may be raised relative to the roller-type brushes 16 and 18, so that the roller-type brushes 16 and 18 contact the surface to be cleaned.

There is placed on the upper side 26 of the housing 12 a dirt container 34 in the form of a dirty water tank 36, on which, in turn, a fresh water tank 38 is placed. The dirty water tank 36 and the fresh water tank 38 will be explained below.

Figure 3:
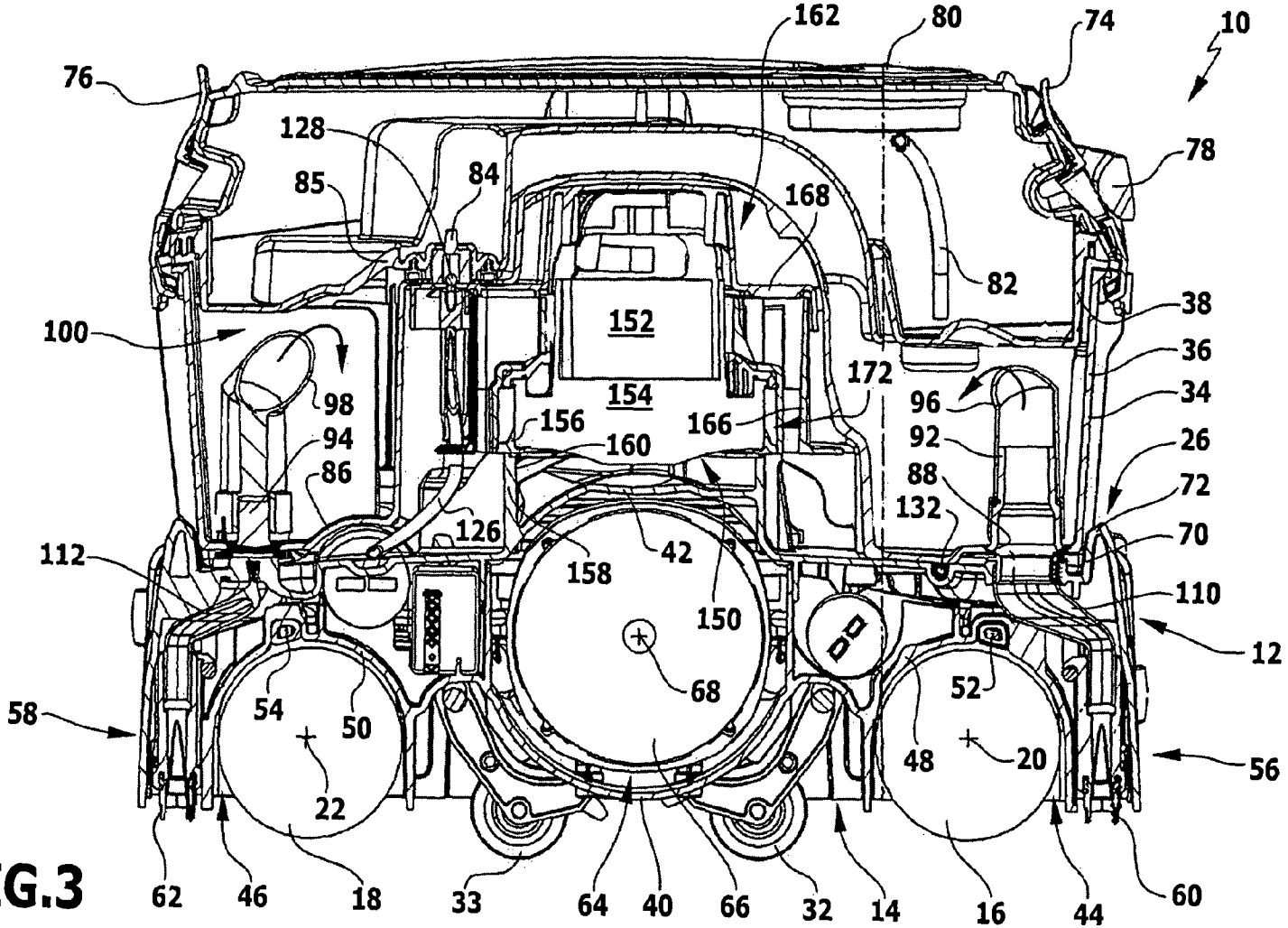
FIG. 3 shows a sectional view taken along line 3-3 in FIG. 2, including the dirty water tank and the fresh water tank of the floor cleaning appliance.
Figure 4:
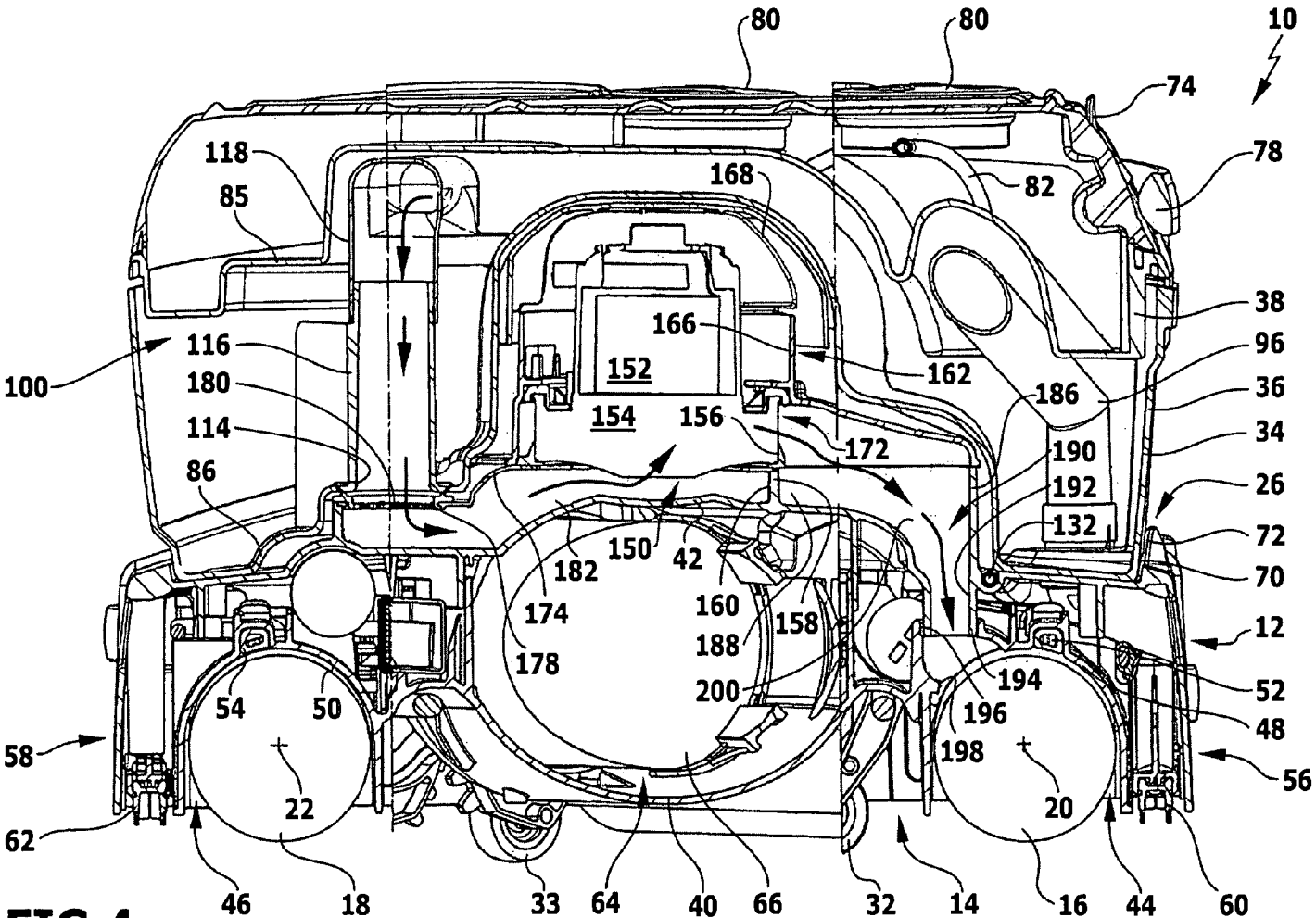
FIG. 4 shows a sectional view taken along line 4-4 in FIG. 2, including the dirty water tank and the fresh water tank of the floor cleaning appliance.

The housing 12 comprises a lower housing part 40 and an upper housing part 42. The lower housing part 40 forms two cleaning compartments 44 and 46 in which the roller-type brushes 16 and 18, respectively, are arranged (FIGS. 3 and 4). The cleaning compartments 44 and 46 are delimited at the sides and at the top by dome-shaped delimiting walls 48 and 50, respectively, in the upper sides of which spraying devices 52 and 54, respectively, are installed.

In a manner described below it is possible to supply the spraying devices 52 and 54 with a cleaning liquid which can be sprayed into the cleaning compartments 44 and 46 in order to act upon the surface to be cleaned with the cleaning liquid. In the present case, water is used as cleaning liquid. To increase the cleaning effect, a chemical cleaning agent may be added to the water.

Between the lower housing part 40 and the upper housing part 42 there are arranged between the roller-type brush 16 and a first transverse side 56 of the housing 12 and between the roller-type brush 18 and a second transverse side 58 of the housing 12 dirt pickup devices in the form of suction ledges 60 and 62, respectively. As described below, these may be acted upon with negative pressure in order to remove by suction from the surface to be cleaned a mixture of dislodged dirt and cleaning liquid, the so-called "soiled liquor".

At its center, the housing 12 has a drive compartment 64 which is formed between the lower housing part 40 and the upper housing part 42 and accommodates a drive device 66, the axis of rotation 68 of which is aligned parallel to the axes of rotation 20 and 22 of the roller-type brushes 16 and 18, respectively. A driving force made available by the drive device 66 may be transmitted by gear mechanisms, known per se and not shown in the drawings, to the roller-type brushes 16 and 18 in order to rotatingly drive these for cleaning the surface to be cleaned.

Figure 5:
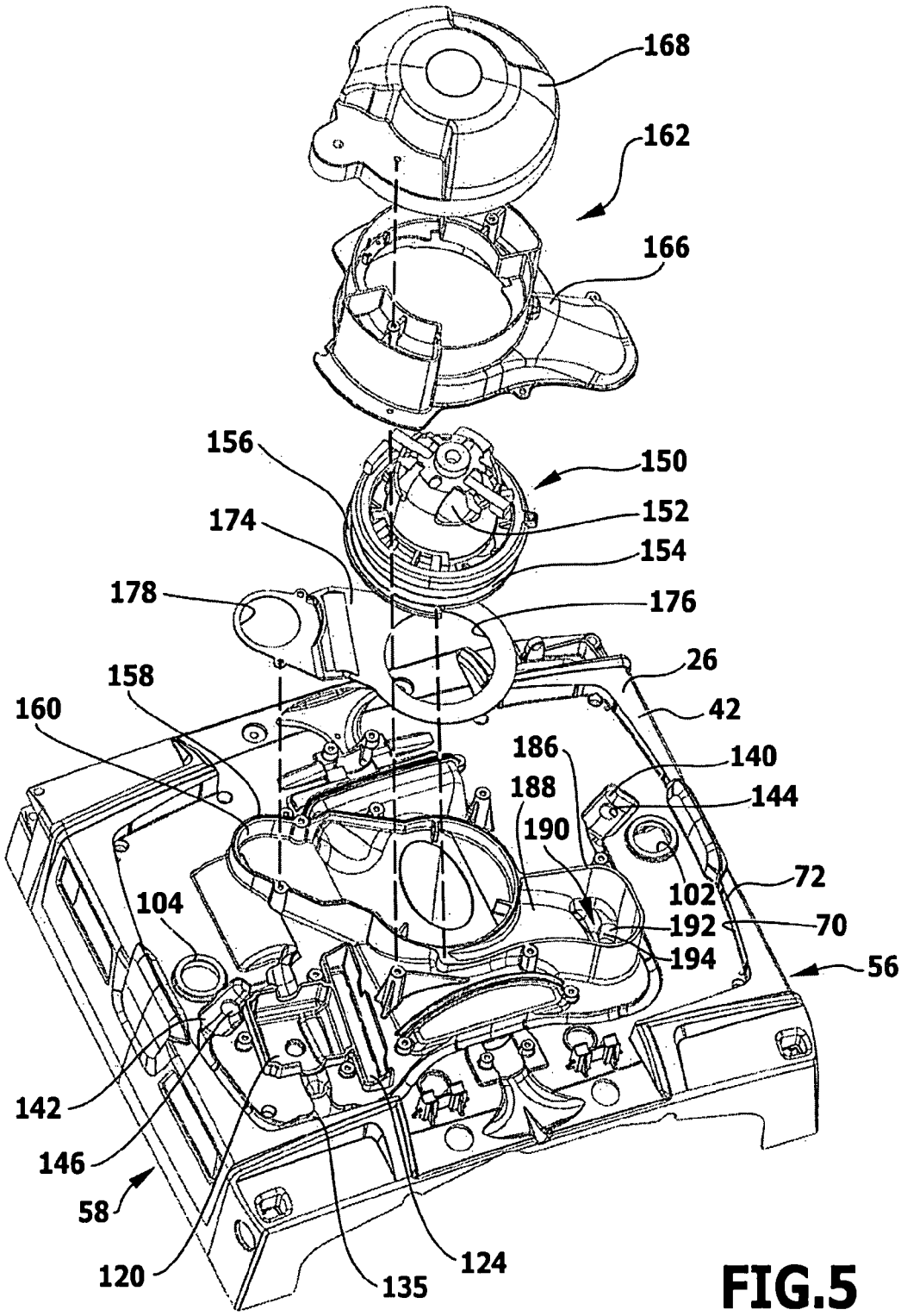
FIG. 5 shows a perspective view of an upper housing part, a cover element, a suction unit and a two-part cover for the suction unit of the floor cleaning appliance from FIG. 1 in an exploded representation.

The upper housing part 42 has on the upper side 26 a dirty water tank receptacle 70 in the form of a tub-shaped depression, which is formed in the upper housing part 42, the upper side of which is of approximately plate-shaped construction (FIG. 5). The tub-shaped depression is delimited in the circumferential direction by a partially interrupted rim 72.

The dirty water tank 36 can be inserted into the dirty water tank receptacle 70 by a user without the need for tools and can be removed from it again without the need for tools. After removal of the dirty water tank 36 and the fresh water tank 38, the scrubber vacuum 10 presents itself as shown in the plan view of FIG. 2, not, taking into account the push bar 28 which is not shown.

As mentioned above, the fresh water tank 38 is placed on the dirty water tank 36 and is releasably connectable to it by connecting elements in the form of clamping brackets 74 and 76. A transportation device in the form of a transportation bracket 78 serves for transportation of the dirty water tank 36 and the fresh water tank 38. The transportation bracket 78 is mounted on the dirty water tank 36 for pivotal movement about an axis of rotation extending parallel to the axes of rotation 20 and 22 and can engage over the fresh water tank 38 during transportation.

Cleaning liquid can be filled into the fresh water tank 38 through a fill-in opening which is closable by a cover 80. Within the fresh water tank 38, the cleaning liquid can be delivered through a withdrawal pipeline 82 arranged in the liquid tank to an outlet connection 84 which is arranged an a bottom wall 85 of the fresh water tank 38 (FIG. 3).

The dirty water tank 36 has a bottom wall 86 with two through-openings, of which only one through-opening 88 is to be seen in FIG. 3. There is arranged at these, facing upwards, a pipe connection 92 and 94, respectively, over which two suction pipes 96 and 100, respectively, are fitted, the open ends of which are located in the interior 100 of the dirty water tank 36.

When the dirty water tank 36 is arranged in the dirty water tank receptacle 70, the through-openings 88 of the bottom wall 86 coincide with two through-openings 102 and 104, respectively, (FIG. 2), formed in the upper housing part 42. Sealing elements 106 and 108 are arranged between the dirty water tank 36 and the upper housing part 42 at the through-openings 102 and 104, respectively.

From the through-openings 102 and 104 of the upper housing part 42 there extend in the direction of the surface to be cleaned pipe sections 110 and 112, respectively, which are connected to the suction ledges 60 and 62, respectively, (FIG. 3). In this way, flow connections exist from the suction ledges 60 and 62 through the pipe sections 110 and 112, respectively, the pipe connections 92 and 94, respectively, and the suction pipes 96 and 98, respectively, into the interior 100 of the dirty water tank 36, with the upper housing part 42 carrying out, so to speak, an "interface function".

The bottom wall 86 of the dirty water tank 36 has a further through-opening 114, from which there extends upwards a pipe connection 116 over which a U-shaped suction pipe 118 is fitted (FIG. 4).

Figure 2:
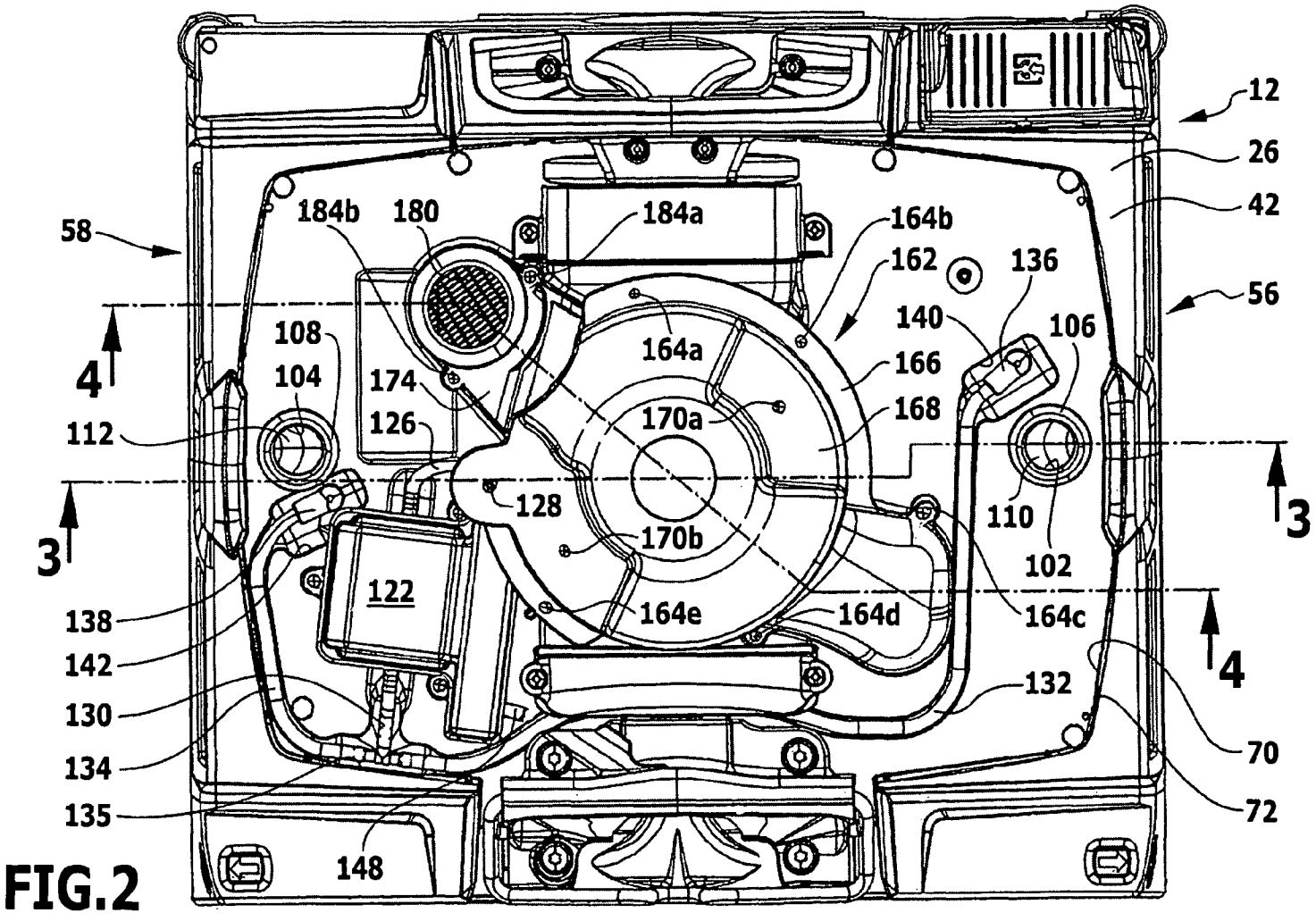
FIG. 2 shows a plan view of the housing of the floor cleaning appliance.

In addition to the dirty water tank receptacle 70 mentioned above, there are formed on the upper housing part 42, as is apparent from FIGS. 2 and 5, further receptacles for functional devices of the scrubber vacuum 10. More particularly, there is formed on the upper housing part 42 a trough-shaped pump receptacle 120 for a liquid pump, which is not shown in the drawings because it is covered by a cover 122 which is releasably connectable to the upper housing part 42. There is formed adjacent to the pump receptacle 120 a shaft-like electric receptacle 124 for an electric connection device in the form of a power strip, the power strip not being shown in the drawings either because it is also covered by the cover 122.

The liquid pump is in flow connection through a supply pipeline 126 and a valve 128, which enters into fluid connection with the outlet connection 84 when the dirty water tank 36 is placed on the upper housing part 42, with the withdrawal pipeline 82 and therefore with the interior of the fresh water tank 38.

Two outgoing pipelines 132 and 134 are connected to the outlet of the liquid pump by a T-shaped distributor pipeline 130, the distributor pipeline 130 and the outgoing pipelines 132 and 134 being arranged in a groove-shaped pipeline receptacle 135 formed on the upper housing part 42.

The ends of the outgoing pipelines 132 and 134 facing away from the liquid pump are connected to the spraying devices 52 and 54, respectively, by angled connection pieces 136 and 138, respectively, arranged in trough-shaped receptacles 140 and 142, respectively. The connection pieces 136 and 138 extend through through-openings 144 and 146, respectively, of the upper housing part 42. In this way, via the connection pieces 136 and 138, respectively, cleaning liquid can be pumped by the liquid pump through the withdrawal pipeline 82, the supply pipeline 126, the distributor pipeline 130 and the outgoing pipelines 132 and 134 to the spraying devices 52 and 54, respectively, in order to act upon the surface to be cleaned with the cleaning liquid.

All of the connections of liquid-conducting components of the scrubber vacuum 10 are constructed as plug-in connections, i.e., the distributor pipeline 130 is connected by a plug-in connection to the outlet of the liquid pump and to the outgoing pipelines 132 and 134, which, in turn, are connected by means of plug-in connections by the connection pieces 136 and 138, respectively, to the spraying devices 52 and 54, respectively. Likewise, the supply pipeline 126 is also pluggable onto the valve 128 and onto the inlet of the liquid pump.

The use of plug-in connections allows a user of the scrubber vacuum 10, in the event of a malfunction, to disconnect liquid-conducting pipelines in a simple way in order to exchange or clean them. Since the user is able to remove the dirty water tank 36 without the need for tools, these liquid-conducting components are accessible to him in a very easy way. In contrast to the liquid-conducting pipelines, the liquid pump and the power strip are covered by the cover 122 to prevent them from being touched. The cover 122 can be removed with a suitable tool by a service technician to allow him access to the liquid pump and the power strip.

The electric lines to be connected to the power strip, of which one electric line 148 in the form of a mains cable is only shown to some extent in FIG. 2, are likewise connectable to the power strip by means of plug-in connections, which additionally increases the service amenability of the scrubber vacuum 10.

For vacuuming-off the mixture of dislodged dirt and cleaning liquid from the surface to be cleaned into the interior 100 of the dirty water tank 36 the scrubber vacuum 10 has a suction unit 150 with which a negative pressure can be generated in the interior 100 (FIGS. 3 to 5). The suction unit 150 is drivable by electric energy and comprises for this purpose a motor 152 shown only diagrammatically with its outline in FIGS. 3 and 4. The motor 152 can drive a turbine wheel, not shown in the drawings, which is arranged in a turbine wheel housing 154, likewise shown only diagrammatically with its outline. With a seal 156 on its underside, the suction unit 150 is placed on a rim 158 of a tub-shaped receptacle 160, which is formed approximately at the center of the upper side 26 of the upper housing part 42.

A cover 162 covering the suction unit 150 is releasably connectable to the upper housing part 42, in the present case, by screw connection with screws 164*a*, 164*b*, 164*c*, 164*d*, 164*e*. The cover 162 is two-part and has a lower cover part 166 releasably screwable to the upper housing part 42, and an upper cover part 168 releasably connectable to the lower cover part 166, in the present case, by screw connection with two screws 170*a*, 170*b* (FIGS. 2 and 5).

The cover part 162 rests on the upper side of the suction unit 150, so that the suction unit 150 is acted upon with force in the direction of the upper housing part 42 by the screw connection of the cover 162 to the upper housing part 42. In this way, the suction unit 150 is held reliably in an accommodating compartment 172 on the upper housing part 42, which is formed between the cover 162 and the upper housing part 42.

For maintenance and/or repair of the suction unit 150, the cover 162 is freely accessible after removal of the dirty water tank 36 from the dirty water tank receptacle 70. It is, for example, possible for a service technician to release the upper cover part 168 from the lower cover part 166 in order to gain access to an upper area of the suction unit 150 facing away from the upper housing part 42. Should this limited access be inadequate for the maintenance and/or repair measure to be taken, he can also release the entire cover 162 from the upper housing part 42 and therefore completely expose the suction unit 150. Since the suction unit 150 is held on the upper housing part 42 solely by the application of force by the cover 162, there is no need for any further release of connecting mechanisms in order to release the suction unit 150 from the housing 12. The scrubber vacuum 10 therefore has a particularly high level of service amenability.

A plate-shaped cover element 174 rests on the rim 158 of the receptacle 160. The cover element 174 comprises a first through-opening 176 which is arranged below the turbine wheel, and a second through-opening 178 which is arranged at the end of the cover element 174 that faces away from the suction unit 150 (FIGS. 3 to 5). When the dirty water tank 36 is arranged in the dirty water tank receptacle 70, the through-opening 178 coincides with the through-opening 114 in the bottom wall 86 of the dirty water tank 36. A sealing filter element 180 is arranged between the dirty water tank 36 and the cover element 174. In this way, there is formed between the cover element 174 and the upper housing part 42 an intake duct 182 by way of which the accommodating compartment 172 is in flow connection with the interior 100 through the pipe connection 116 and the suction pipe 118 for subjection of the interior 100 to a negative pressure.

The cover element 174 is releasably connectable to the upper housing part 42, in the present case, by connecting elements in the form of two screws 184*a*, 184*b* (FIG. 2). This allows, after release of the cover 162 and the suction unit 150 from the housing 12, the cover element 174 to be released from the housing 12, which may be necessary, for example, when there is foreign matter in the intake duct 182.

After release of the dirty water tank 36 from the dirty water tank receptacle 70, the filter element 180 is freely accessible, which also has an advantageous effect on the service amenability of the scrubber vacuum 10 as it is thereby made possible for the filter element 180 to be exchanged or cleaned in an easy way.

Adjacent to the receptacle 160, the upper housing part 42 has a tub-shaped depression 188 bordered by a rim 186. The depression 188 opens into a shaft 190 which forms a through-opening 192 of the upper housing part 42 (FIGS. 4 and 5). The shaft 190 is surrounded by a wall 194 which in the direction of the underside 14 of the housing 12 engages an opening 196 in the lower housing part 40. The opening 196 expands in the direction of the surface to be cleaned in order to form in the delimiting wall 48 of the cleaning compartment 46 an outlet opening 198 of an exhaust air duct 200 which is formed in this way.

The exhaust air duct 200 forms an exhaust air guiding device for the exhaust air of the suction unit 150, and as well as by the upper housing part 42 and by the lower housing part 40 it is also delimited by a section of the cover 162 that covers the rim 186. A flow connection is created between the accommodating compartment 172 and the cleaning, compartment 44 by the exhaust air duct 200, so that exhaust air discharged by the suction unit 150 can be conducted through the exhaust air duct 200 into the cleaning compartment 44.

A flow of exhaust air discharged by the suction unit 150 can thereby be conducted through the exhaust air duct 200 onto the side of the roller-type brush 16 that faces away from the surface to be cleaned and is spatially distributed in an effective way by the roller-type brush 16 as a result of its rotary motion. This allows the noises of the flow of exhaust air of the suction unit 150 to be effectively reduced.

As a result of the flow of exhaust air being conducted onto the side of the roller-type brush 16 that faces away from the surface to be cleaned, it can also be ensured that dirt on the surface to be cleaned will not be spatially distributed in an undesired manner and the cleaning result thereby impaired.

Owing to the widening of the section of the exhaust air duct 200 in the area before the outlet opening 198, the velocity of the flow of exhaust air is reduced before it enters the cleaning compartment 44. The flow of exhaust air is directed approximately onto the center of the roller-type brush 16, in relation to its longitudinal extent. These constructional measures have proven particularly effective in bringing about a reduction in the noise generation of the scrubber vacuum 10.

In a variant of the scrubber vacuum 10 it may be provided that the cleaning compartment 46 is also in flow connection with the accommodating compartment 172 for the suction unit 150 by way of an exhaust air duct in order to also direct a flow of exhaust air from the suction unit 150 onto the roller-type brush 18.

The invention claimed is:

1. Floor cleaning appliance, comprising:

a housing, at least one drivable cleaning tool arranged on an underside of the housing for removing dirt from a surface to be cleaned;

a suction unit arranged at or on an upper side of the housing for vacuuming-off the dirt;

a dirt container for receiving the vacuumed-off dirt;

wherein said housing comprises:

a dirt container receptacle in which said dirt container is releasably positionable, and, at least one functional device receptacle for at least one functional device, said at least one functional device or a cover of said at least one functional device being freely accessible after removal of said dirt container from said dirt container receptacle; and a cover for covering the suction unit, said cover being releasably connectable to the housing and being freely accessible after removal of the dirt container from the dirt container receptacle.

2. Floor cleaning appliance in accordance with claim 1, wherein at least one of the at least one functional device receptacle and the dirt container receptacle is constructed in a form of a depression formed on the housing.

3. Floor cleaning appliance in accordance with claim 1, wherein at least one of the at least one functional device receptacle and the dirt container receptacle is formed on an upper side of the housing.

4. Floor cleaning appliance in accordance with claim 1, wherein at least one of the at least one functional device receptacle accommodates at least one liquid pipeline.

5. Floor cleaning appliance in accordance with claim 4, wherein two or more liquid pipelines are connectable to one another by plug-in connections.

6. Floor cleaning appliance in accordance with claim 1, wherein at least one of the at least one functional device receptacle accommodates at least one electric line.

7. Floor cleaning appliance in accordance with claim 6, wherein two or more electric lines are connectable to one another by plug-in connections.

8. Floor cleaning appliance in accordance with claim 1, wherein the cover comprises a lower cover part by means of which the cover is releasably connectable to the housing, and an upper cover part which is releasably connectable to the lower cover part.

9. Floor cleaning appliance in accordance with claim 1, wherein the housing comprises at least one through-opening for passage of at least one of an electric line and a liquid pipeline therethrough.

10. Floor cleaning appliance in accordance with claim 1, wherein the housing comprises at least one through-opening through which a medium drawn in or discharged by the suction unit is drawn in or discharged.

11. Floor cleaning appliance in accordance with claim 1, wherein the housing comprises an upper housing part and a lower housing part, at least one of the dirt container receptacle and the at least one functional device receptacle being arranged at the upper housing part, and the lower housing part forming at least one cleaning compartment in which at least one of the at least one cleaning tool is arranged.

12. Floor cleaning appliance in accordance with claim 11, wherein a drive compartment is formed between the upper housing part and the lower housing part for accommodating a drive device by means of which the at least one cleaning tool is drivable.

13. Floor cleaning appliance in accordance with claim 12, wherein:

the floor cleaning appliance comprises two cleaning tools constructed as roller-type brushes which are mounted for rotation in two cleaning compartments on the housing, and the drive device is arranged in the drive compartment between the roller-type brushes and has a drive axis extending parallel to axes of rotation of the roller-type brushes.

14. Floor cleaning appliance in accordance with claim 1, wherein the floor cleaning appliance is constructed as a scrubber vacuum.

15. Floor cleaning appliance in accordance with claim 1, wherein the floor cleaning appliance comprises an exhaust air guiding device for directing an exhaust air flow of the exhaust air of the suction unit onto at least one of the at least one cleaning tool.

16. Floor cleaning appliance in accordance with claim 15, wherein the floor cleaning appliance comprises an accommodating compartment for the suction unit and at least one cleaning compartment formed on the housing for accommodating at least one of the at least one cleaning tool, the exhaust air guiding device forming at least one exhaust air duct by way of which the accommodating compartment is in flow connection with at least one of the at least one cleaning compartment.

17. Floor cleaning appliance in accordance with claim 16, wherein the housing delimits the exhaust air duct, at least in sections thereof.

18. Floor cleaning appliance in accordance with claim 17, wherein one of the sections of the housing that delimits the at least one exhaust air duct is formed as a through-opening of the housing.

19. Floor cleaning appliance in accordance with claim 16, wherein the housing comprises a wall delimiting the at least one cleaning compartment and forming at least one outlet opening of at least one of the at least one exhaust air duct.

20. Floor cleaning appliance in accordance with claim 16, wherein the floor cleaning appliance comprises a cover which is releasably connectable to the housing and has a first section delimiting at least one of the at least one exhaust air duct, at least in sections thereof.

21. Floor cleaning appliance in accordance with claim 20, wherein the cover has a second section, the accommodating compartment for the suction unit being formed between the second section and the housing.

22. Floor cleaning appliance, comprising:

a housing, at least one drivable cleaning tool arranged on an underside of the housing for removing dirt from a surface to be cleaned;

a suction unit for vacuuming-off the dirt;

a dirt container for receiving the vacuumed-off dirt;

wherein said housing comprises:

a dirt container receptacle in which said dirt container is releasably positionable, at least one functional device receptacle for at least one functional device, said at least one functional device or a cover of said at least one functional device being freely accessible after removal of said dirt container from said dirt container receptacle; and at least one of the at least one functional device receptacle accommodates a liquid pump for conveying a cleaning liquid.

23. Floor cleaning appliance in accordance with claim 22, wherein the liquid pump is connectable to at least one liquid pipeline by plug-in connections.

24. Floor cleaning appliance in accordance with claim 22, wherein:

the suction unit is arranged at or on an upper side of the housing, and the floor cleaning appliance has a cover for covering the suction unit, said cover being releasably connectable to the housing and being freely accessible after removal of the dirt container from the dirt container receptacle.

25. Floor cleaning appliance, comprising:

a housing, at least one drivable cleaning tool arranged on an underside of the housing for removing dirt from a surface to be cleaned;

a suction unit for vacuuming-off the dirt;

a dirt container for receiving the vacuumed-off dirt;

wherein said housing comprises:

a dirt container receptacle in which said dirt container is releasably positionable, at least one functional device receptacle for at least one functional device, said at least one functional device or a cover of said at least one functional device being freely accessible after removal of said dirt container from said dirt container receptacle; and at least one of the at least one functional device receptacle accommodates at least one electric device of the floor cleaning appliance.

26. Floor cleaning appliance in accordance with claim 25, wherein the electric device is connectable to at least one electric line by plug-in connections.

* * * * *

UNITED STATES PATENT AND TRADEMARK OFFICE

CERTIFICATE OF CORRECTION

PATENT NO. : 8,087,123 B2
APPLICATION NO. : 12/803954
DATED : January 3, 2012
INVENTOR(S) : Merz et al.

It is certified that error appears in the above-identified patent and that said Letters Patent is hereby corrected as shown below:

On the title page, item (75), should read:

Inventors: Juergen Merz, Waiblingen (DE); Juergen Walz, Moeckmuehl (DE)

Signed and Sealed this
Twenty-eighth Day of February, 2012

David J. Kappos

David J. Kappos
*Director of the United States Patent and Trademark Office*